US008556250B2

(12) United States Patent
Takahata et al.

(10) Patent No.: US 8,556,250 B2
(45) Date of Patent: Oct. 15, 2013

(54) SHEET FEEDING DEVICES, IMAGE READING DEVICES AND IMAGE FORMING DEVICES

(75) Inventors: Muneaki Takahata, Nagoya (JP); Huiqing Xu, Nagoya (JP); Takashi Fujiwara, Nagakute (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 13/359,527

(22) Filed: Jan. 27, 2012

(65) Prior Publication Data

US 2012/0248687 A1 Oct. 4, 2012

(30) Foreign Application Priority Data

Mar. 31, 2011 (JP) ..... 2011-076992

(51) Int. Cl.
*B65H 83/00* (2006.01)

(52) U.S. Cl.
USPC ..... 271/3.14; 271/171; 271/223

(58) Field of Classification Search
USPC ..... 271/3.14, 145, 171, 220, 223, 9.11
See application file for complete search history.

(56) References Cited

U.S. PATENT DOCUMENTS

| | | | | |
|---|---|---|---|---|
| 5,377,966 | A * | 1/1995 | Ohmori | 271/4.01 |
| 8,041,283 | B2 | 10/2011 | Murai | |
| 2008/0205952 | A1 | 8/2008 | Murai | |

FOREIGN PATENT DOCUMENTS

| | | | |
|---|---|---|---|
| JP | 63-247228 | | 10/1988 |
| JP | 01-089150 | | 6/1989 |
| JP | 01-097955 | | 6/1989 |
| JP | 02-055649 | | 2/1990 |
| JP | 04-125250 | | 4/1992 |
| JP | H06-16344 | A | 1/1994 |
| JP | 07-115503 | | 5/1995 |
| JP | 2001-088981 | | 4/2001 |
| JP | 2008-213946 | A | 9/2008 |

OTHER PUBLICATIONS

JP Office Action dtd Jun. 11, 2013, JP Appln. 2011-076992, English translation.

* cited by examiner

*Primary Examiner* — Michael McCullough
(74) *Attorney, Agent, or Firm* — Banner & Witcoff, Ltd.

(57) ABSTRACT

A sheet feeding device includes a sheet placement portion, a regulating portion, and an output portion. The regulating portion includes a first regulating portion and a second regulating portion. At least one of the first regulating portion and the second regulating portion can move in the width direction. The output portion includes a first output portion that extends from the first regulating portion toward the second regulating portion, and a second output portion that extends from the second regulating portion toward the first regulating portion. The first output portion includes a first end portion. The second output portion includes a second end portion. In a proximity state, the first end portion is located closer to the second regulating portion than the second end portion. The proximity state is a state in which a distance between the first regulating portion and the second regulating portion is at a minimum.

10 Claims, 18 Drawing Sheets

SHEET FEEDING DEVICES, IMAGE READING DEVICES AND IMAGE FORMING DEVICES

CROSS-REFERENCE TO RELATED APPLICATION

This application claims priority to Japanese Patent Application No. 2011-076992, filed Mar. 31, 2011, the content of which is hereby incorporated herein by reference in its entirety.

BACKGROUND

The present disclosure relates to a sheet feeding device that feeds sheets of different sizes placed thereon, and an image reading device and an image forming device that are provided with the sheet feeding device.

A sheet feeding device, an image reading device, an image forming device and the like are known that includes a paper feed tray and a paper output tray. The sheet feeding device includes the paper feed tray, guide portions and the paper output tray. The sheet feeding device reverses, inside a main body, the sheet that is taken from the paper feed tray into the main body, and ejects the sheet to the paper output tray that is provided on the same side as the paper feed tray with respect to the main body. The paper feed tray is a plate on which the sheets are stacked on top of one another. A pair of the guide portions are provided on both sides of the paper feed tray in a width direction of the sheet. The pair of guide portions can adjust a position in the width direction of the sheet. The paper output tray is connected to both of the pair of guide portions. The paper output tray extends from both of the pair of guide portions toward an inner side in the width direction of the sheet. The paper output tray can receive the sheet ejected from the main body. Even when a sheet of a different size is placed on the paper feed tray, this sheet feeding device can align the sheet by adjusting a distance between the guide portions and can feed the sheet to the main body.

SUMMARY

There is a case in which a sheet having a small width, such as a postcard or a name card, is used. In this case, with the known sheet feeding device, in order to align the sheet and feed the sheet to the main body, it is necessary to reduce the distance between the guide portions on both the sides by moving the guide portions closer to each other. When the distance between the guide portions on both the sides is reduced, paper output tray portions that are connected to the guide portions may contact with each other. In a case where the paper output tray portions contact with each other, it may not be possible to further reduce the distance between the guide portions. Therefore, for example, in a case where a sheet having a small width is placed, there is a case in which the guide portions cannot contact with both edges of the sheet. As a result, there is a case in which the sheet having a small width cannot be aligned and fed to the main body.

Various embodiments of the broad principles derived herein provide a sheet feeding device, an image reading device and an image forming device which are capable of aligning a sheet having a small width and feeding it to a main body and which are also capable of receiving the sheet ejected from the main body.

Embodiments provide a sheet feeding device that includes a sheet placement portion, a regulating portion, and an output portion. The sheet placement portion configured to receive the sheet to be fed in a feed direction. The regulating portion configured to regulate, from both sides in a width direction, a position in the width direction of the sheet placed on the sheet placement portion. The width direction is a direction orthogonal to the feed direction. The regulating portion includes a first regulating portion and a second regulating portion. The first regulating portion configured to regulate the position in the width direction of the sheet from one of the sides in the width direction. The second regulating portion configured to regulate the position in the width direction of the sheet from the other side in the width direction. At least one of the first regulating portion and the second regulating portion configured to move in the width direction. The output portion configured to receive the sheet that is ejected. The output portion includes a first output portion and a second output portion. The first output portion extends from the first regulating portion toward the second regulating portion. The second output portion extends from the second regulating portion toward the first regulating portion. The first output portion includes a first end portion that comes closest to the second regulating portion among sections of an edge of the first output portion on the second regulating portion side. The second output portion includes a second end portion that comes closest to the first regulating portion among sections of an edge of the second output portion on the first regulating portion side. In a proximity state, the first end portion is located closer to the second regulating portion than the second end portion. The proximity state is a state in which a distance between the first regulating portion and the second regulating portion is at a minimum.

Embodiments also provide an image reading device that includes a sheet placement portion, a regulating portion, a reading portion, and an output portion. The sheet placement portion configured to receive the sheet to be fed in a feed direction. The regulating portion configured to regulate, from both sides in a width direction, a position in the width direction of the sheet placed on the sheet placement portion. The width direction is a direction orthogonal to the feed direction. The regulating portion includes a first regulating portion and a second regulating portion. The first regulating portion configured to regulate the position in the width direction of the sheet from one of the sides in the width direction. The second regulating portion configured to regulate the position in the width direction of the sheet from the other side in the width direction. At least one of the first regulating portion and the second regulating portion configured to move in the width direction. The reading portion configured to read an image of the sheet that is fed. The output portion configured to receive the sheet whose image has been read by the reading portion. The output portion includes a first output tray and a second output portion. The first output portion extends from the first regulating portion toward the second regulating portion. The second output portion extends from the second regulating portion toward the first regulating portion. The first output portion includes a first end portion that comes closest to the second regulating portion among sections of an edge of the first output portion on the second regulating portion side. The second output portion includes a second end portion that comes closest to the first regulating portion among sections of an edge of the second output portion on the first regulating portion side. In a proximity state, the first end portion is located closer to the second regulating portion than the second end portion. The proximity state is a state in which a distance between the first regulating portion and the second regulating portion is at a minimum.

Embodiments further provide an image forming device that includes a sheet placement portion, a regulating portion, a reading portion, an image forming portion, and output portion. The sheet placement portion configured to receive the sheet to be fed in a feed direction. The regulating portion configured to regulate, from both sides in a width direction, a position in the width direction of the sheet placed on the sheet placement portion. The width direction is a direction orthogonal to the feed direction. The regulating portion includes a first regulating portion and a second regulating portion. The first regulating portion configured to regulate the position in the width direction of the sheet from one of the sides in the width direction. The second regulating portion configured to regulate the position in the width direction of the sheet from the other side in the width direction. At least one of the first regulating portion and the second regulating portion configured to move in the width direction. The reading portion configured to read an image of the sheet that is fed. The image forming portion configured to perform image forming on a recording medium based on the image read by the reading portion. The output portion configured to receive the sheet on which image forming has been performed by the image forming portion. The output portion includes a first output portion and a second output portion. The first output portion extends from the first regulating portion toward the second regulating portion. The second output portion extends from the second regulating portion toward the first regulating portion. The first output portion includes a first end portion that comes closest to the second regulating portion among sections of an edge of the first output portion on the second regulating portion side. The second output portion includes a second end portion that comes closest to the first regulating portion among sections of an edge of the second output portion on the first regulating portion side. In a proximity state, the first end portion is located closer to the second regulating portion than the second end portion. The proximity state is a state in which a distance between the first regulating portion and the second regulating portion is at a minimum.

BRIEF DESCRIPTION OF THE DRAWINGS

Embodiments will be described below in detail with reference to the accompanying drawings in which.

DETAILED DESCRIPTION

Figure 1:
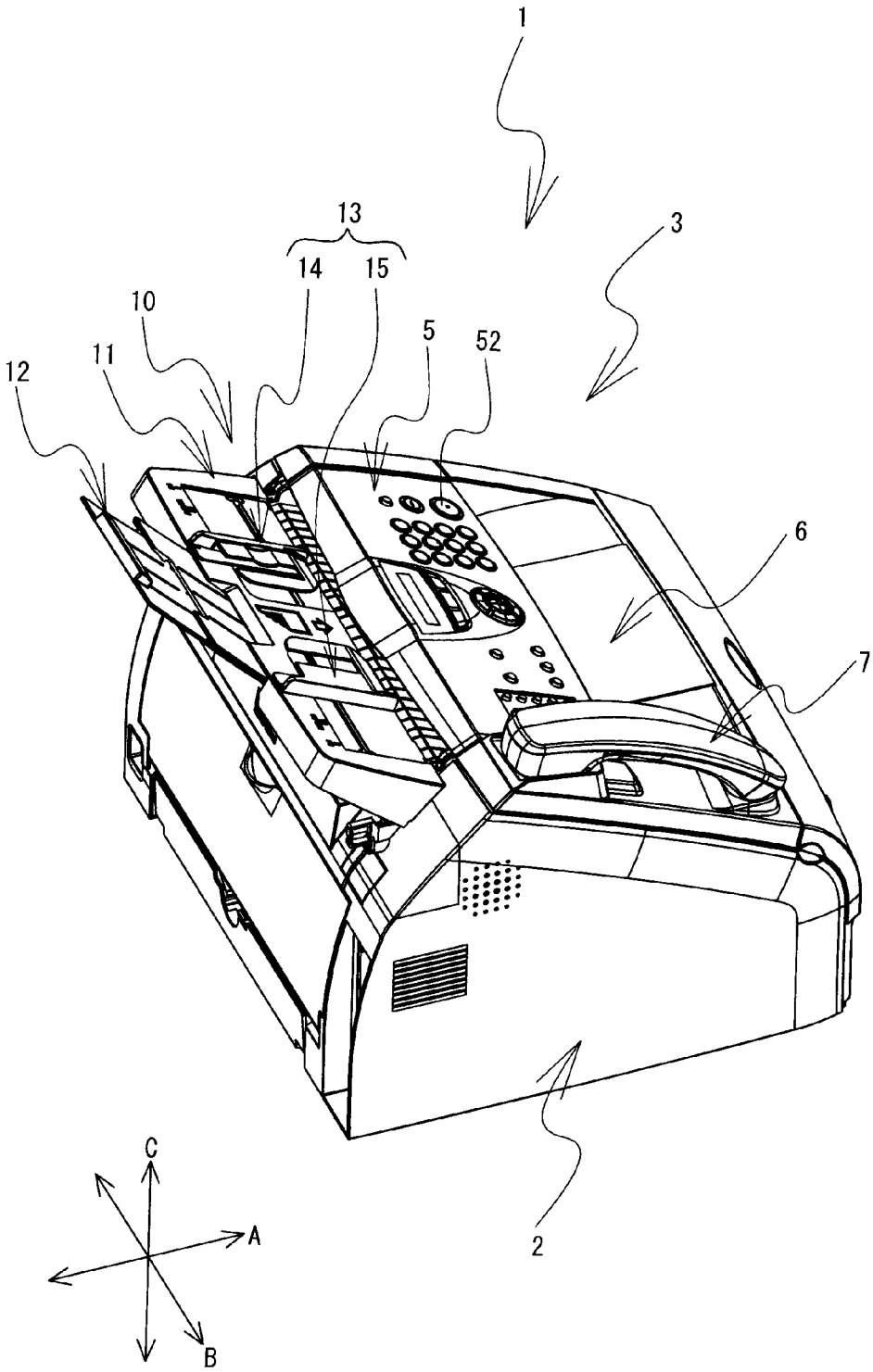
FIG. 1 is a perspective view of a multifunction machine that is an embodiment of the present disclosure.

Hereinafter, embodiments of the present disclosure will be explained with reference to the drawings. In the explanation below, the upper right side, the lower left side, the upper left side and the lower right side of FIG. 1 and FIG. 2 respectively correspond to the front, the rear, the right side and the left side of a multifunction machine 1. The right side, the left side, the depth direction and the front direction of FIG. 4 respectively correspond to the front, the rear, the right side and the left side of the multifunction machine 1. In FIG. 1, a direction in which a sheet is fed is a feed direction. Arrows A in FIG. 1 correspond to the feed direction. In FIG. 1, on a surface of a sheet that is placed on a feed tray 11, a direction that is orthogonal to the feed direction of the sheet is a width direction. Arrows B in FIG. 1 correspond to the width direction. In FIG. 1, a direction that is orthogonal to the surface of the sheet that is placed on the feed tray 11 is a vertical direction. Arrows C in FIG. 1 correspond to the vertical direction.

A configuration of the multifunction machine 1 of an embodiments will be explained with reference to FIG. 1. The multifunction machine 1 is a multi-functional device that may include a telephone function, a printer function, a scanner function, a copy function, a facsimile function and so on. The multifunction machine 1 includes an image reading device 3, a printing portion 4 shown in FIG. 4, an operation panel 5, a telephone receiver 7, the feed tray 11, an output tray 6 and so on. The image reading device 3 is provided on an upper portion of a main body 2 having a substantially cubic shape. The printing portion 4 is provided below the image reading device 3. The operation panel 5 is removably provided on an upper portion of the image reading device 3. The output tray 6 is provided in front of the operation panel 5. An ejected recording medium is received by an upper portion of the output tray 6. The telephone receiver 7 is provided immediately to the left of the operation panel 5. The feed tray 11 is provided on a rear side of the upper portion of the main body 2. The feed tray 11 is a plate-shaped member that extends diagonally upward and rearward. An extension guide 12 is provided in a central portion in the left-right direction of an upper edge portion of the feed tray 11. The extension guide 12 can expand and contract diagonally upward and rearward.

The image reading device 3 includes a reading portion 8 and an automatic document feeder 10. Hereinafter, the automatic document feeder 10 is referred to as an ADF 10. The reading portion 8 can read the image formed on a surface of the sheet. The ADF 10 can feed the sheet to the reading portion 8. The printing portion 4 can form an image on a recording medium, such as paper, stored below the main body 2.

Sheets may be placed on the feed tray 11. A sheet guide 13 that is provided on the feed tray 11 can regulate the position of the sheet placed on the feed tray 11, and an upper portion of the sheet guide 13 can receive the sheet ejected from the image reading device 3. The sheet guide 13 includes a first sheet guide 14 and a second sheet guide 15. The first sheet guide 14 is provided on the right side above the feed tray 11. The second sheet guide 15 is provided on the left side above the feed tray 11.

Figure 2:
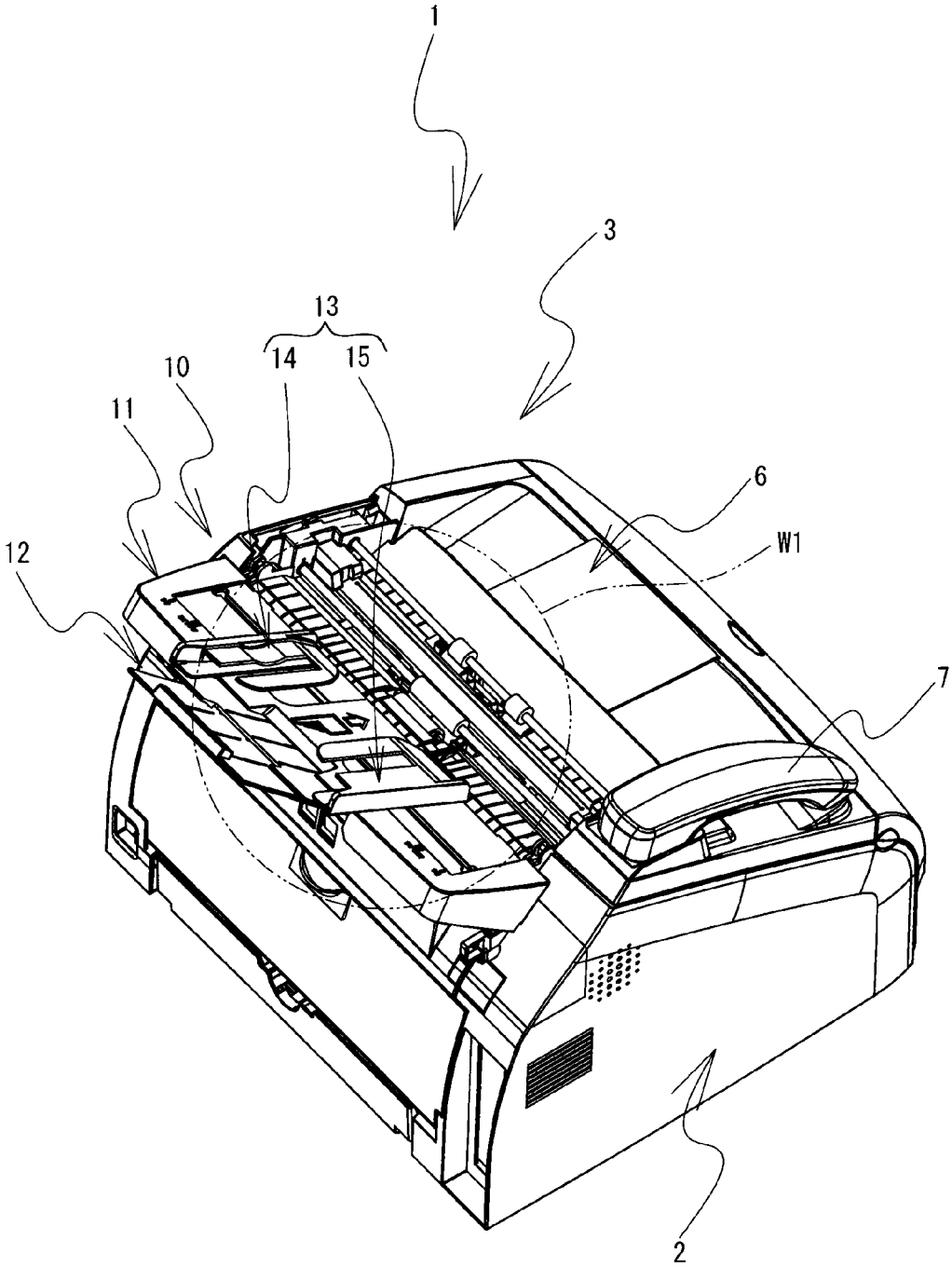
FIG. 2 is a perspective view of a state in which an operation panel is removed from the multifunction machine.
Figure 3:
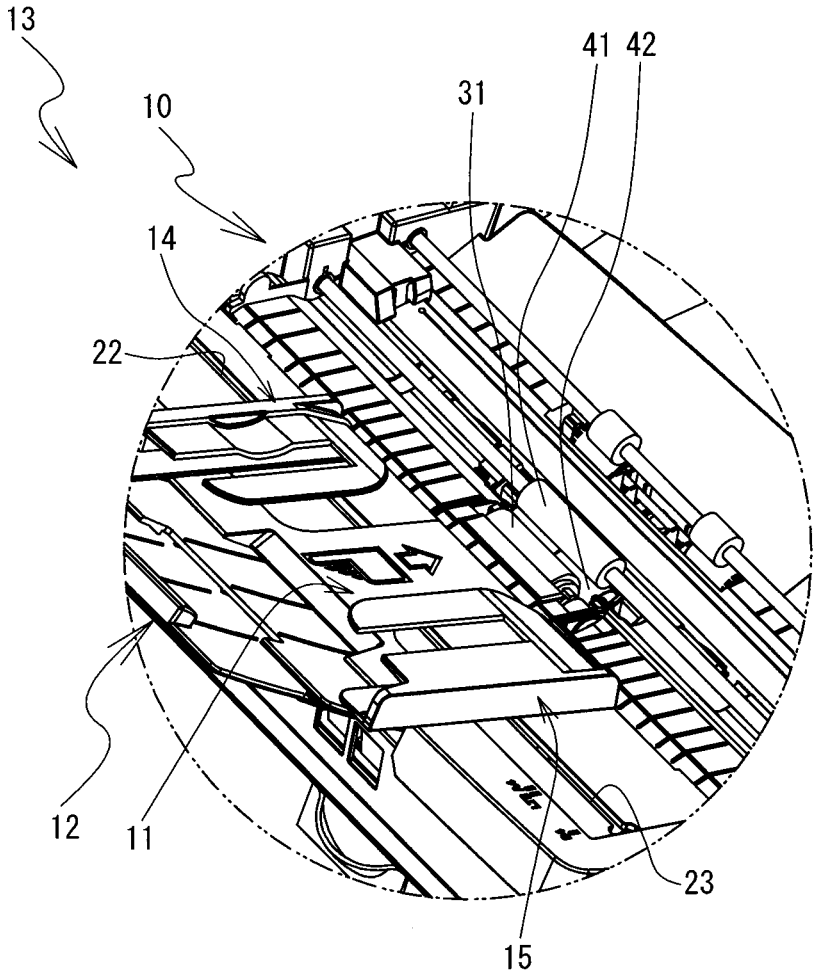
FIG. 3 is a partial enlarged view inside an area of the multifunction machine that is enclosed by a broken line W1 in FIG. 2.

As shown in FIG. 1 and FIG. 2, the operation panel 5 can be removed from the main body 2. When the operation panel 5 is removed from the main body 2, the ADF 10 is exposed as shown in FIG. 3. The ADF 10 includes a separation roller 31, a conveyance roller 41 and a pinch roller 42. The separation roller 31 separates the sheet one at a time in order from the sheet positioned lowermost among the plurality of sheets stacked and placed on the feed tray 11, and takes out the sheet. The conveyance roller 41 comes into contact with the upper surface of the sheet separated out by the separation roller 31 and applies a conveyance force to the sheet. The pinch roller 42 pushes the sheet from below toward the conveyance roller 41.

Figure 4:
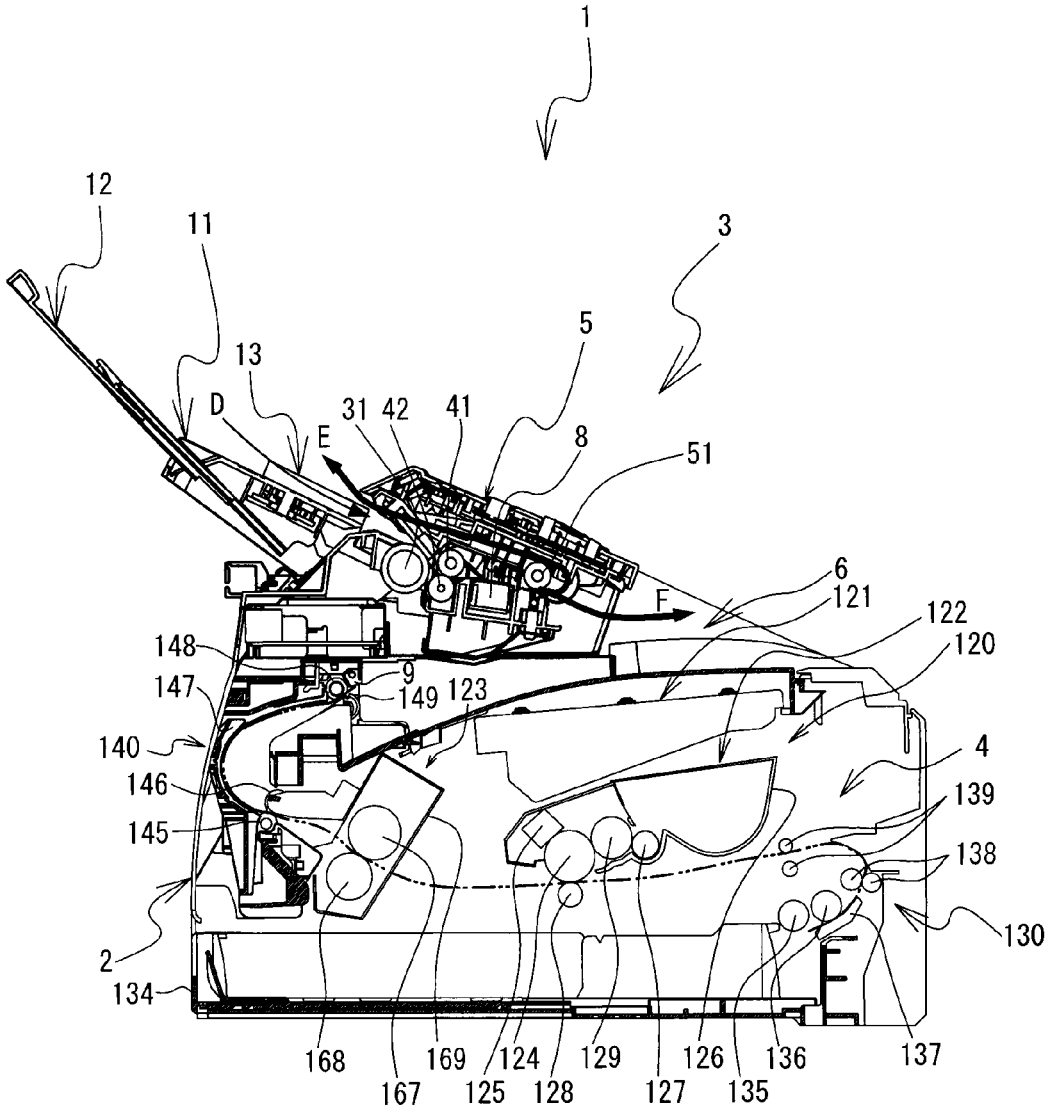
FIG. 4 is a cross-sectional view along a front-rear direction of the multifunction machine shown in FIG. 1.

A start button 52 shown in FIG. 1 can be used to command the start of reading of an image. When a user presses the start button 52 and commands the start of reading of the image, the separation roller 31 takes out the sheet placed on the feed tray 11 one at a time as shown in FIG. 4. The conveyance roller 41 can feed the sheet to the front (a direction indicated by an arrow D in FIG. 4) and leads the sheet to the reading portion 8. The reading portion 8 can read the image of the sheet. The read image of the sheet may be stored in a memory (not shown in the figures) provided inside the main body 2. The feed direction of the sheet is reversed from the front to the rear inside the main body 2 by a reverse roller 51. The sheet is ejected toward the upper side (in a direction indicated by an arrow E in FIG. 4) of the sheet placed on the feed tray 11. The sheet guide 13 can receive the ejected sheet by the upper portion of the sheet guide 13.

The sheet whose image has been read may be fed in a direction indicated by an arrow F as it is, without the feed direction of the sheet being reversed by the reverse roller 51, and the sheet may be ejected onto a tray (not shown in the figures) provided above the output tray 6. For example, in a case where the sheet is a postcard or a name card, the sheet may be fed in the direction of the arrow F.

The printing portion 4 can transfer a developer image onto a recording medium such as paper (hereinafter referred to as printing paper) and form an image. The printing paper on which image forming is completed by the printing portion 4 may be ejected to the output tray 6.

The printing portion 4 includes an image forming portion 120, a feeder portion 130, and a conveyance unit 140 etc. The image forming portion 120 can form the image stored in the memory (not shown in the figures) of the multifunction machine 1 onto the printing paper. The image formed on the printing paper is the image that has been read by the reading portion 8. The feeder portion 130 can supply the printing paper to the image forming portion 120. The conveyance unit 140 can turn the printing paper, on which the image forming by the image forming portion 120 is complete, by substantially 180 degrees in the upward direction, and feed the rotated printing paper to the output tray 6.

As shown in FIG. 4, the feeder portion 130 includes a paper feed tray 134, a paper feed roller 135, a separation roller 136 and a separation pad 137, a pair of conveyance rollers 138 and a pair of resist rollers 139. The paper feed tray 134 is removably attached to a lowermost portion of the main body 2. The paper feed roller 135 is provided on top of a front end portion of the paper feed tray 134, and feeds the printing paper to the image forming portion 120. The separation roller 136 and the separation pad 137 separate out the printing paper fed by the paper feed roller 135 into individual sheets.

The pair of conveyance rollers 138 is provided further on a downstream side from the separation roller 136, in the printing paper feed direction. The pair of conveyance rollers 138 feeds the printing paper fed by the paper feed roller 135 toward the image forming portion 120. The pair of resist rollers 139 is provided on an input side of the image forming portion 120. The pair of resist rollers 139 applies a predetermined feed resistance to the printing paper being fed and thus regulates a feed state of the printing paper.

The image forming portion 120 includes an exposure device 121, a developing device 122 and a fuser 123 etc. The exposure device 121 is provided on an uppermost portion inside the main body 2. The image forming portion 120 includes a laser light source, a polygon mirror, an fθ lens and a reflecting mirror etc., which are not shown in the figures. The image forming portion 120 can form an electrostatic latent image on a top surface of a photoconductive drum 124, which will be explained later.

The developing device 122 is removably housed inside the main body 2, below the exposure device 121. The developing device 122 includes the photoconductive drum 124, an electrifier 125 and a developer storing portion 126. The photoconductive drum 124 temporarily holds the developer image that is transferred onto the printing paper. The electrifier 125 can electrify the top surface of the photoconductive drum 124. The developer holding portion 126 can store developer. A feed roller 127 and a developing roller 129 are provided between the developer holding portion 126 and the photoconductive drum 124. The feed roller 127 and the developing roller 129 can supply the developer taken out from the developer storing portion 126 to the photoconductive drum 124.

The developer that has been taken out of the developer storing portion 126 is fed to the developing roller 129 side by rotation of the feed roller 127. After the developer that has been fed to the developing roller 129 side is temporarily held on the surface of the developing roller 129, it is fed to the top surface of the photoconductive drum 124, which has been exposed to light by the exposure device 121. A transfer roller 128 is provided in a position facing the photoconductive drum 124 such that the transfer roller 128 and the photoconductive drum 124 sandwich the printing paper that is being fed. The transfer roller 128 carries an electrical charge that is the opposite of the electrical charge with which the photoconductive drum 124 has been electrified. The transfer roller 128 can rotate synchronously with the photoconductive drum 124. The developer generated on the surface of the photoconductive drum 124 is transferred onto a printing surface of the printing paper.

The fuser 123 includes a heating roller 167, a pressure roller 168 and a casing 169 etc. The heating roller 167 can heat the developer image that is disposed on the side of the printing surface of the printing paper. The pressure roller 168 is provided on an opposite side to the heating roller 167, such that the pressure roller 168 and the heating roller 167 sandwich the printing paper, and the pressure roller 168 presses the printing paper to the heating roller 167 side. The casing 169 can store the heating roller 167 and the pressure roller 168.

The conveyance unit 140 is provided on the downstream side with respect to the fuser 123, in the printing paper feed direction. The conveyance unit 140 forms a feed passage that is substantially U-shaped and that runs from the fuser 123 to an ejection opening 9 side. The conveyance unit 140 includes a pair of conveyance rollers 145 and 146, a turning guide 147 and a pair of ejecting rollers 148 and 149 etc.

The conveyance rollers 145 and 146 come into contact with the printing paper ejected from the fuser 123 and feed the printing paper by rotating. The turning guide 147 is provided further on the downstream side than the conveyance rollers 145 and 146, in the feed direction. The turning guide 147 is provided on a loop back portion of the feed passage that is bent in the substantially U shape. The turning guide 147 turns the feed direction of the printing paper ejected from the conveyance rollers 145 and 146 by approximately 180 degrees in the upward direction. The ejecting rollers 148 and 149 are provided on the ejection opening 9 side on the feed passage. The ejecting rollers 148 and 149 can discharge the printing paper to the output tray 6.

Next, the sheet guide 13 will be explained. As shown in FIG. 3, the first sheet guide 14 and the second sheet guide 15 are arranged facing each other in a direction orthogonal to the feed direction. Hereinafter, the direction orthogonal to the feed direction is referred to as the width direction. The first sheet guide 14 can regulate, from the right side, the position in the width direction of the sheet placed on the feed tray 11. The second sheet guide 15 can regulate, from the left side, the position in the width direction of the sheet placed on the feed tray 11. The sheet guide 13 can regulate the position in the width direction of the sheet with respect to the feed tray 11, by sandwiching the sheet placed on the feed tray 11 from both sides in the width direction. By regulating the sheet in this way, the sheet is aligned. By aligning the sheet in this way, it is possible to avoid that diagonal movement (skewing) of the sheet, and a failure in which the image read out from the sheet is tilted is prevented from occurring.

The first sheet guide 14 can receive the ejected sheet by an upper portion of the first sheet guide 14. The first sheet guide 14 can support the ejected sheet from the right side in the width direction of the sheet and from below. The second sheet guide 15 can receive the ejected sheet by an upper portion of the second sheet guide 15. The second sheet guide 15 can support the ejected sheet from the left side in the width direction of the sheet and from below. The sheet placed on the feed tray 11 and the ejected sheet are placed in separate positions.

The first sheet guide 14 is engaged with a groove 22. The groove 22 is provided in a right side region of a placement surface of the feed tray 11, and on the front side of the feed tray 11. The second sheet guide 15 is engaged with a groove 23. The groove 23 is provided in a left side region of the placement surface of the feed tray 11, and on the front side of the feed tray 11. The grooves 22 and 23 are provided in parallel with the width direction of the sheet. The first sheet guide 14 can move in the width direction along the groove 22. The second sheet guide 15 can move in the width direction along the groove 23.

The first sheet guide 14 and the second sheet guide 15 are connected with each other by a gear mechanism (not shown in the figures) that is provided inside the main body 2. For example, in a case where the user moves the first sheet guide 14 from the right side to the center of the feed tray 11, the second sheet guide 15 may also move in conjunction with the movement of the first sheet guide 14, from the left side to the center of the feed tray 11. Conversely, in a case where the user moves the first sheet guide 14 from the center to the right side of the feed tray 11, the second sheet guide 15 may also move in conjunction with the movement of the first sheet guide 14, from the center to the left side of the feed tray 11. By this linked movement, the user can easily and rapidly adjust the distance between the first sheet guide 14 and the second sheet guide 15 within predetermined distance range in accordance with a length in the width direction of the sheet placed on the feed tray 11. The predetermined distance range may depend on the shape of sheet guide 13 and grooves 22 and 23. For example, minimum distance of the predetermined distance range may be the distance when part of the first sheet guide 14 and the second sheet guide 15 contact with each other in the width direction. By this movement, the first sheet guide 14 and the second sheet guide 15 can be located close to each other (minimum distance). Hereinafter, in a case where the word "close to each other" is used in the present disclosure, it means that the first sheet guide 14 and the second sheet guide 15 are in a state which a distance between the first sheet guide 14 and the second sheet guide 15 is at a minimum. In other words, in this case, the first sheet guide 14 and the second sheet guide 15 are in a proximity state. Also, the first sheet guide 14 and the second sheet guide 15 can be separated from each other. In addition, the user can reliably place the sheet on a central portion in the width direction of the feed tray 11. The reading portion 8 can accurately read the image from the sheet.

Figure 5:
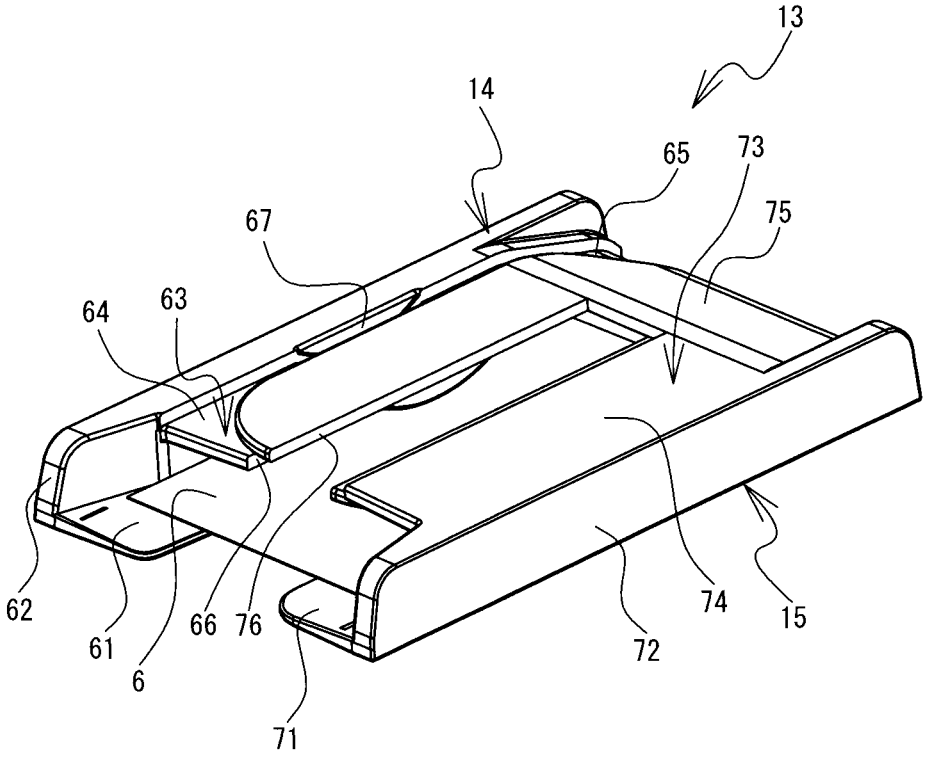
FIG. 5 is a perspective view showing a state in which, among sheet guides of the multifunction machine of the embodiment, a first sheet guide and a second sheet guide are located close to each other.
Figure 6:
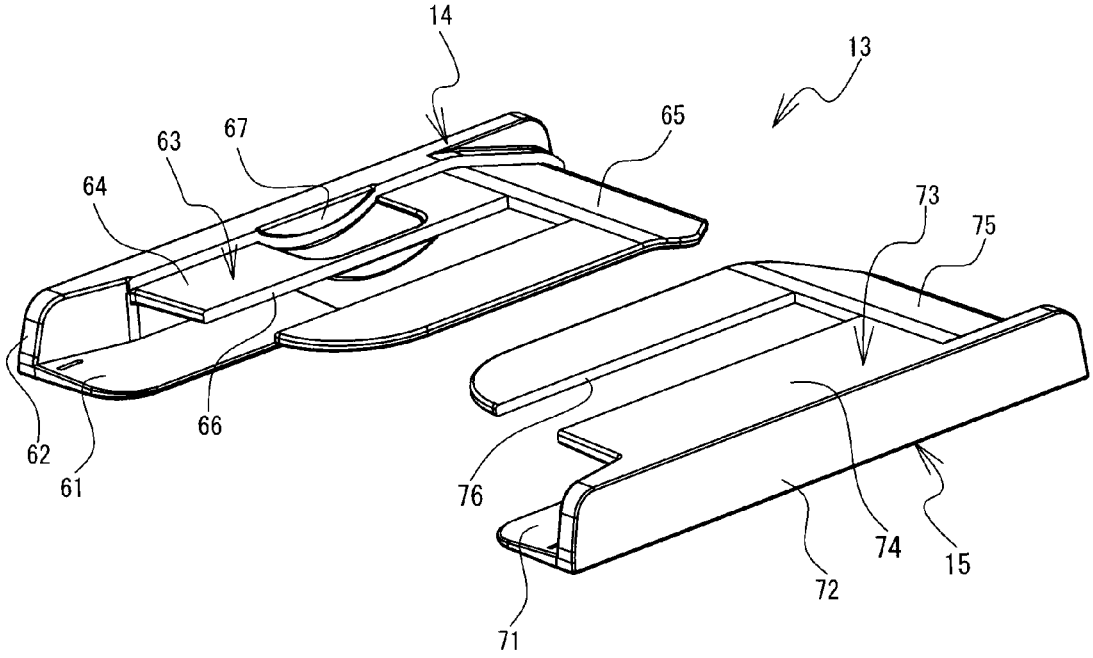
FIG. 6 is a perspective view showing a state in which, among the sheet guides of the multifunction machine of the embodiment, the first sheet guide and the second sheet guide are separated from each other.
Figure 7:
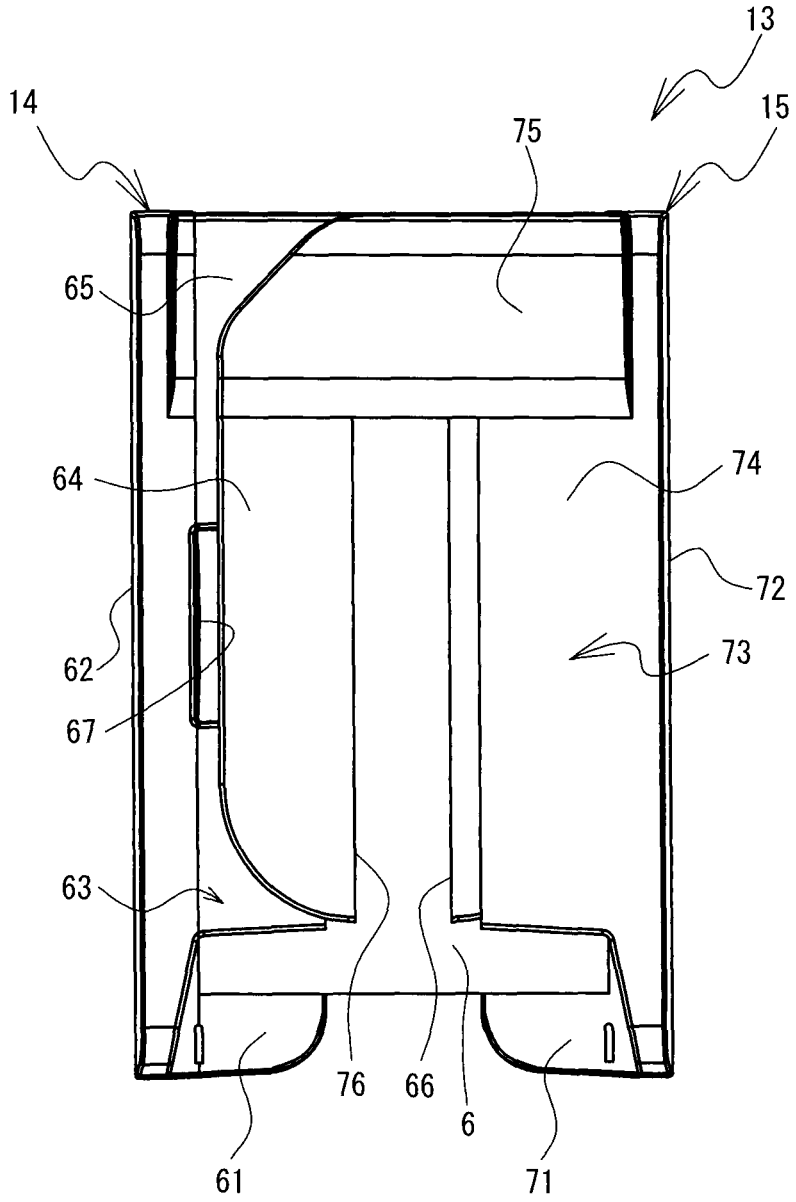
FIG. 7 is a plan view of the sheet guides of the multifunction machine of the embodiment.
Figure 8:
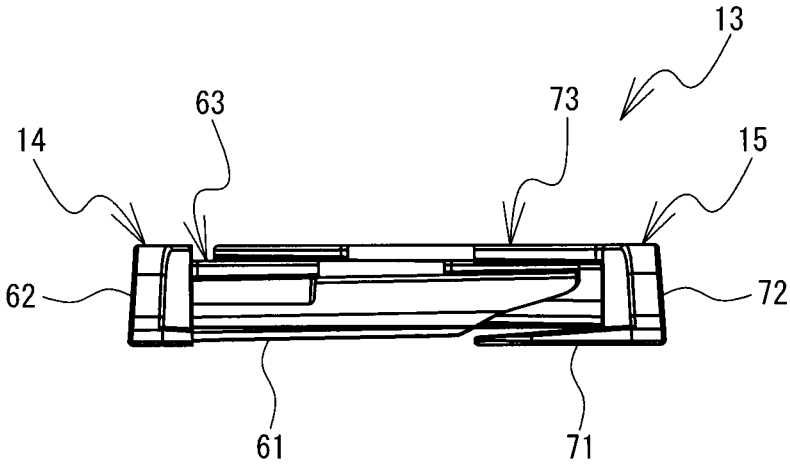
FIG. 8 is a rear view of the sheet guides of the multifunction machine of the embodiment.

With reference to FIG. 5 to FIG. 8, the shape of the sheet guide 13 will be explained. FIG. 5, FIG. 7 and FIG. 8 each show a state in which the first sheet guide 14 and the second sheet guide 15 are located close to each other. FIG. 6 shows a state in which the first sheet guide 14 and the second sheet guide 15 are separated from each other. For example, in a case where a sheet having a small width, such as a postcard or a name card, is used, the sheet is fed in a state in which the first sheet guide 14 and the second sheet guide 15 are close to each other as shown in FIG. 5, FIG. 7 and FIG. 8. For example, in a case where a sheet having a certain level of width, such as normal paper, is used, the sheet is fed in a state in which the first sheet guide 14 and the second sheet guide 15 are separated from each other as shown in FIG. 6. As shown in FIG. 5 and FIG. 6, the first sheet guide 14 include a first placement portion 61, a first regulating portion 62 and a first output tray 63. The first placement portion 61 is a substantially rectangular shaped portion in a plan view, whose longitudinal direction corresponds to the feed direction. The right side in the width direction of a sheet 6 is placed on an upper surface of the first placement portion 61. The upper surface of the first placement portion 61 is parallel to an upper surface of the feed tray 11 shown in FIG. 1. Note that the word "parallel" does not mean being strictly parallel. This is because there is a case in which the upper surface of the first placement portion 61 tilts slightly with respect to the upper surface of the feed tray 11, depending on a molding condition etc. Therefore, when the word "parallel" is used in the present disclosure, it does not mean being strictly parallel, but means being substantially parallel. This also applies to other expressions, such as "vertical", "orthogonal", "above", "below" and the like.

The first regulating portion 62 extends substantially vertically upward from the right edge of the first placement portion 61, and is a plate-shaped portion that extends in the feed direction. The first regulating portion 62 can contact with the right side in the width direction of the sheet 6 and can regulate the position of the sheet 6 from the right side.

The first output tray 63 is a portion that extends to the left from the first regulating portion 62. As shown in FIG. 6, the length in the width direction of the first output tray 63 is approximately 2.5 times the length in the width direction of the first placement portion 61. The first output tray 63 can support the ejected sheet from the right side in the width direction of the sheet and from below. The first output tray 63 includes a horizontal portion 64 and an inclined portion 65. The horizontal portion 64 is a plate-shaped portion that extends in parallel with the first placement portion 61, from slightly below the upper edge of the first regulating portion 62. A distance from the upper edge of the first regulating portion 62 to the upper edge of the horizontal portion 64 is substantially the same as a thickness of a second output tray 73, which will be described later. The horizontal portion 64 is a plate-shaped portion whose longitudinal direction corresponds to the feed direction. A recessed portion 67 is provided in a substantially central portion of the horizontal portion 64 in the feed direction. The user can easily move the first sheet guide 14 in the width direction by inserting his/her finger in the recessed portion 67 and moving his/her finger in the width direction.

The inclined portion 65 is a portion that extends toward the front from the front end of the horizontal portion 64. The inclined portion 65 is a plate-shaped portion that extends in the feed direction. The inclined portion 65 is inclined downward toward the front. The sheet that is ejected toward the rear can be smoothly guided to the horizontal portion 64 by the inclined portion 65.

As shown in FIG. 5 and FIG. 6, the second sheet guide 15 includes a second placement portion 71, a second regulating portion 72 and the second output tray 73. The second placement portion 71 is a plate-shaped portion that extends in the feed direction. The left side in the width direction of the sheet 6 can be placed on an upper surface of the second placement portion 71. The upper surface of the second placement portion 71 is parallel to the upper surface of the feed tray 11 shown in FIG. 1. The second placement portion 71 and the first placement portion 61 are bilaterally symmetrical.

The second regulating portion 72 extends substantially vertically upward from the left edge of the second placement portion 71, and is a plate-shaped portion that extends in the feed direction. The second regulating portion 72 can contact with the left side in the width direction of the sheet 6 and can regulate the position of the sheet 6 from the left side. The second regulating portion 72 and the first regulating portion 62 are bilaterally symmetrical.

The second output tray 73 is a portion that extends to the right from the second regulating portion 72. As shown in FIG. 6, the length in the width direction of the second output tray 73 is approximately 2.5 times the length in the width direction of the second placement portion 71, and it is the same as the length in the width direction of the first output tray 63. The second output tray 73 can support the ejected sheet from the left side in the width direction of the sheet and from below. The second output tray 73 includes a horizontal portion 74 and an inclined portion 75. The horizontal portion 74 is a plate-shaped portion, and extends in parallel with the second placement portion 71 from the upper edge of the second regulating portion 72. The horizontal portion 74 is a plate-shaped portion whose longitudinal direction corresponds to the feed direction. The inclined portion 75 is a portion that extends toward the front from the front end of the horizontal portion 74. The inclined portion 75 is a plate-shaped portion that extends in the feed direction. The inclined portion 75 is inclined downward toward the front. The sheet that is ejected toward the rear can be smoothly guided to the horizontal portion 74 by the inclined portion 75.

In the embodiment, in a case where the sheet guide 13 is mounted on the feed tray 11, the height from the feed tray 11 to the first output tray 63 is different from the height from the feed tray 11 to the second output tray 73. In the embodiment, as shown in FIG. 8, the difference is equivalent to a thickness of the second output tray 73. Therefore, as shown in FIG. 5, even when the first sheet guide 14 and the second sheet guide 15 are moved close to each other, the left edge of the first output tray 63 and the right edge of the second output tray 73 do not contact with each other, and the first output tray 63 and the second output tray 73 are overlap with each other in the vertical direction. As a result, there is no interference between the first output tray 63 and the second output tray 73. Therefore, the distance between the first regulating portion 62 and the second regulating portion 72 can be reduced to a state in which the left edge of the first output tray 63 comes into contact with the second regulating portion 72 and the right edge of the second output tray 73 comes into contact with the first regulating portion 62.

The first output tray 63 includes the left edge which corresponds to an end portion of the first output tray 63. The left edge of the first output tray 63 includes a section that comes to closest to the second regulating portion 72 among sections of edge of the first output tray 63. The second output tray 73 includes the right edge which corresponds to an end portion of the second output tray 73. The right edge of the second output tray 73 includes a section that comes closest to the first regulating portion 62 among sections of the edge of the second output tray 73. In a case where the first sheet guide 14 and the second sheet guide 15 are moved close to each other, the left edge of the first output tray 63 is positioned closer to the second regulating portion 72 than the right edge of the second output tray 73. Similarly, the right edge of the second output tray 73 is positioned closer to the first regulating portion 62 than the left edge of the first output tray 63. Accordingly, as compared to a configuration in which there is mutual interference between the edges of left and right output trays, it is possible to shorten the distance between the first regulating portion 62 and the second regulating portion 72. This is because, in the configuration in which there is mutual interference between the edges of the left and right output trays, the distance between the first regulating portion and the second regulating portion is equal to a sum of the lengths, in the extending direction, of the left and right output trays. Therefore, with the sheet guide 13, even when a sheet having a short length in the width direction, such as a postcard or a name card, is placed on the feed tray 11, it is possible to align the sheet by moving the first regulating portion 62 and the second regulating portion 72 close to each other. Due to the alignment of the sheet, skewing of the sheet can be prevented. Therefore, the multifunction machine 1 can accurately read the image from the sheet.

As shown in FIG. 6 and FIG. 7, a cutout portion 66 is provided in the horizontal portion 64 of the first output tray 63. The cutout portion 66 is a portion that is cut out in a rectangular shape from the rear end of the horizontal portion 64 toward the front. Similarly, a cutout portion 76 is provided in the horizontal portion 74 of the second output tray 73. The cutout portion 76 is a portion that is cut out in a rectangular shape from the rear end of the horizontal portion 74 toward the front. The cutout portions 66 and 76 are provided in a section where the first sheet guide 14 and the second sheet guide 15 overlap with each other in the vertical direction in a state in which the first regulating portion 62 and the second regulating portion 72 are located close to each other. With reference to FIG. 5, a case will be explained in which the sheet is placed on the sheet guide 13 in a state in which the first sheet guide 14 and the second sheet guide 15 are located close to each other. The user may place the sheet on the lower side of the first output tray 63 and the second output tray 73, and on the downstream side in the feed direction. If the output tray does not include cutout portions as represented by the cutout portions 66 and 76, the output tray obstructs a user's operation to place the sheet. As a result, the user may not place the sheet on the downstream side in the feed direction, and may not place the sheet as far as a most downstream portion of the feed tray. In contrast to this, the first output tray 63 and the second output tray 73 of the present embodiment include the cutout portion 66 and the cutout portion 76, respectively. Therefore, the user can easily place the sheet as far as a downstream portion of the feed tray 11, via the cutout portions 66 and 76. Therefore, the sheet placed on the feed tray 11 can be reliably taken out by the ADF 10 and may be fed toward the reading portion 8.

In a case where a name card or a postcard is used as the sheet, the sheet has a short length in the width direction. Therefore, the user moves the first sheet guide 14 and the second sheet guide 15 close to each other. The sheet is ejected, for example, to a tray (not shown in the figures) that may be provided above the output tray 6. If the sheet feeding device does not include a structure like the cutout portions 66 and 76 of the present embodiment, the first output tray and the second output tray act as an obstacle in a case where the sheet is placed on the downstream side of the feed tray. In contrast, the multifunction machine 1 of the present embodiment includes the cutout portions 66 and 76. Therefore, in a case where the sheet is fed, the sheet can be reliably fed and placed on the downstream side of the feed tray 11. As a result, the sheet placed on the feed tray 11 can be aligned and skewing can be prevented. At the same time, reading of the image can be reliably performed.

As explained above, in the sheet guide 13 of the embodiment, the height from the feed tray 11 to the first output tray 63 is different from the height from the feed tray 11 to the second output tray 73. In a case where the first sheet guide 14 and the second sheet guide 15 are moved close to each other, the first output tray 63 and the second output tray 73 overlap with each other in the vertical direction. As a result, the distance between the first regulating portion 62 and the second regulating portion 72 can be made smaller than the sum of the lengths, in the width direction, of the first output tray 63 and the second output tray 73. Since the distance between the first regulating portion 62 and the second regulating portion 72 can be shortened, it is possible to align the sheet having a small width. The multifunction machine 1 can accurately read the image from the sheet.

Further, even when the first sheet guide 14 and the second sheet guide 15 are located close to each other, there is no mutual interference between the first output tray 63 and the second output tray 73. Therefore, the user can freely move the first sheet guide 14 and the second sheet guide 15 in the width direction, and can freely change the distance between the first regulating portion 62 and the second regulating portion 72 depending on size of the sheet.

Moreover, in the sheet guide 13, the first output tray 63 and the second output tray 73 can be overlapped with each other in the vertical direction, and it is therefore possible to increase a surface area of the first output tray 63 and the second output tray 73. More specifically, in a case where the first output tray and the second output tray cannot be overlapped with each other in the vertical direction, in order to align and feed the sheet having a small width, it is necessary to design the first output tray and the second output tray such that their length in the width direction is short. In this case, the surface area of the first output tray and the second output tray becomes small. In a case where the surface area of the first output tray and the second output tray becomes small, the sheet placed on the first output tray and the second output tray becomes unstable in a state in which the first sheet guide and the second sheet guide are separated from each other. In contrast to this, in the present embodiment, the first output tray 63 and the second output tray 73 can be overlapped with each other in the vertical direction, and therefore it is possible to increase the surface area of the first output tray 63 and the second output tray 73. Accordingly, for example, in a case where the sheet is ejected to the first output tray 63 and the second output tray 73 in a state in which the first sheet guide 14 and the second sheet guide 15 are separated from each other, the ejected sheet can be stably placed on the first output tray 63 and the second output tray 73.

In addition, the first output tray 63 and the second output tray 73 include the cutout portions 66 and 76, respectively. Therefore, the user can easily place the sheet as far as the most downstream portion of the feed tray 11 via the cutout portions 66 and 76. Thus, the sheet placed on the feed tray 11 can be reliably taken out by the ADF 10 and fed toward the reading portion 8.

Note that the present disclosure is not limited to the above-described embodiment, and various modifications are possible. In the present disclosure, the first sheet guide 14 and the second sheet guide 15 move in the width direction in conjunction with each other. However, one of the first sheet guide 14 and the second sheet guide 15 only may move and the other of the first sheet guide 14 and the second sheet guide 15 may be fixed to the feed tray 11. In the embodiment, in a case where the first regulating portion 62 and the second regulating portion 72 are located close to each other, the left edge of the first output tray 63 comes into contact with the second regulating portion 72 and the right edge of the second output tray 73 comes into contact with the first regulating portion 62. However, in a case where the first regulating portion 62 and the second regulating portion 72 are located close to each other, one of the left edge of the first output tray 63 and the right edge of the second output tray 73 only may contact with the first regulating portion 62 or the second regulating portion 72.

In the sheet guide 13, the first output tray 63 and the second output tray 73 overlap with each other in the vertical direction in a state in which the first sheet guide 14 and the second sheet guide 15 are located close to each other. However, the first output tray 63 and the second output tray 73 need not necessarily overlap with each other in the vertical direction. Alternatively, only a part of the first output tray 63 may overlap with a part of the second output tray 73 in the vertical direction.

In the above-described embodiment, the sheet guide 13 includes the first placement portion 61 and the second placement portion 71. However, the sheet guide 13 need not necessarily be provided with placement portions represented by the first placement portion 61 and the second placement portion 71. For example, the sheet may be placed directly on the feed tray 11. The cutout portions 66 and 76 extend respectively from the rear ends of the horizontal portions 64 and 74 toward the front. However, the present disclosure is not limited to this example. The cutout portions may extend from the front ends toward the rear. Further, the cutout portions need not necessarily have a rectangular shape. For example, the cutout portions may have a triangular shape or a semicircular shape.

The another embodiment will be explained. The another embodiment is different from the above-described embodiment in that the sheet guide 13 is replaced by a sheet guide 16. Hereinafter, the sheet guide 16 will be explained. FIG. 1 to FIG. 4 are also applied to the another embodiment, except that the sheet guide 13 is replaced by the sheet guide 16. The explanation of FIG. 1 to FIG. 4 is omitted.

Figure 9:
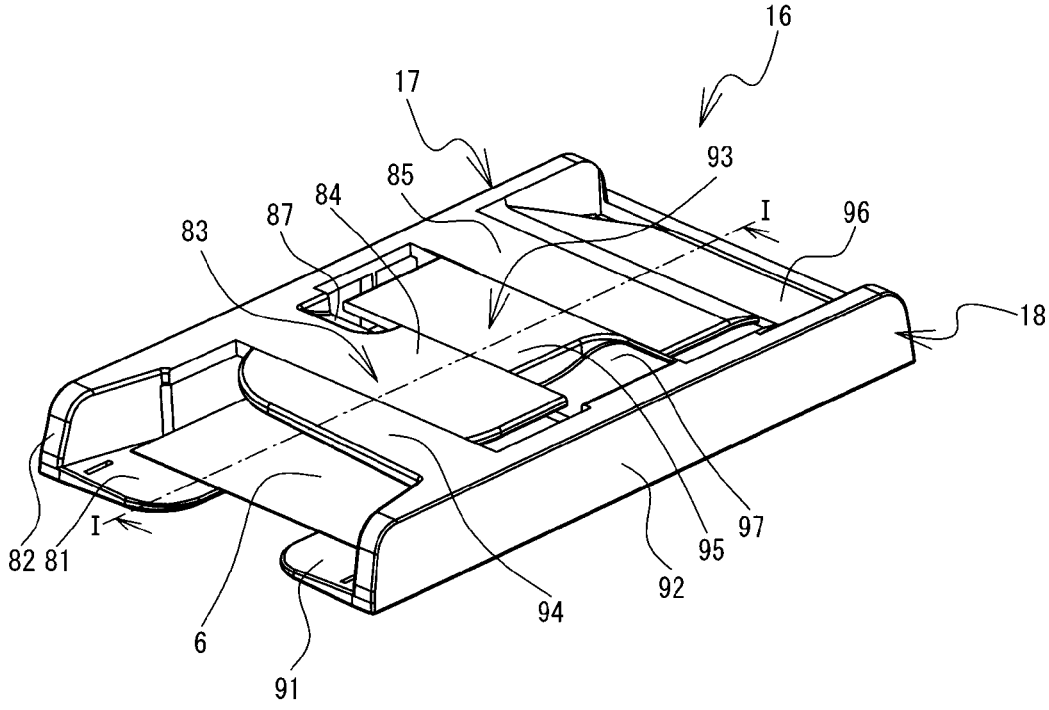
FIG. 9 is a perspective view showing a state in which, among sheet guides of the multifunction machine of an another embodiment, a first sheet guide and a second sheet guide are located close to each other.
Figure 10:
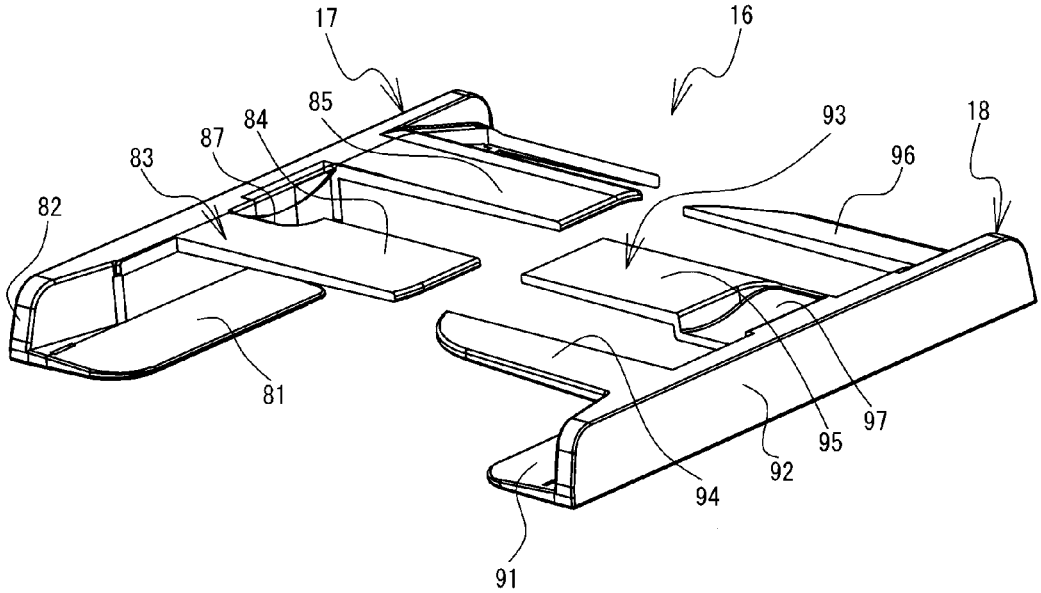
FIG. 10 is a perspective view showing a state in which, among the sheet guides of the multifunction machine of the another embodiment, the first sheet guide and the second sheet guide are separated from each other.
Figure 11:
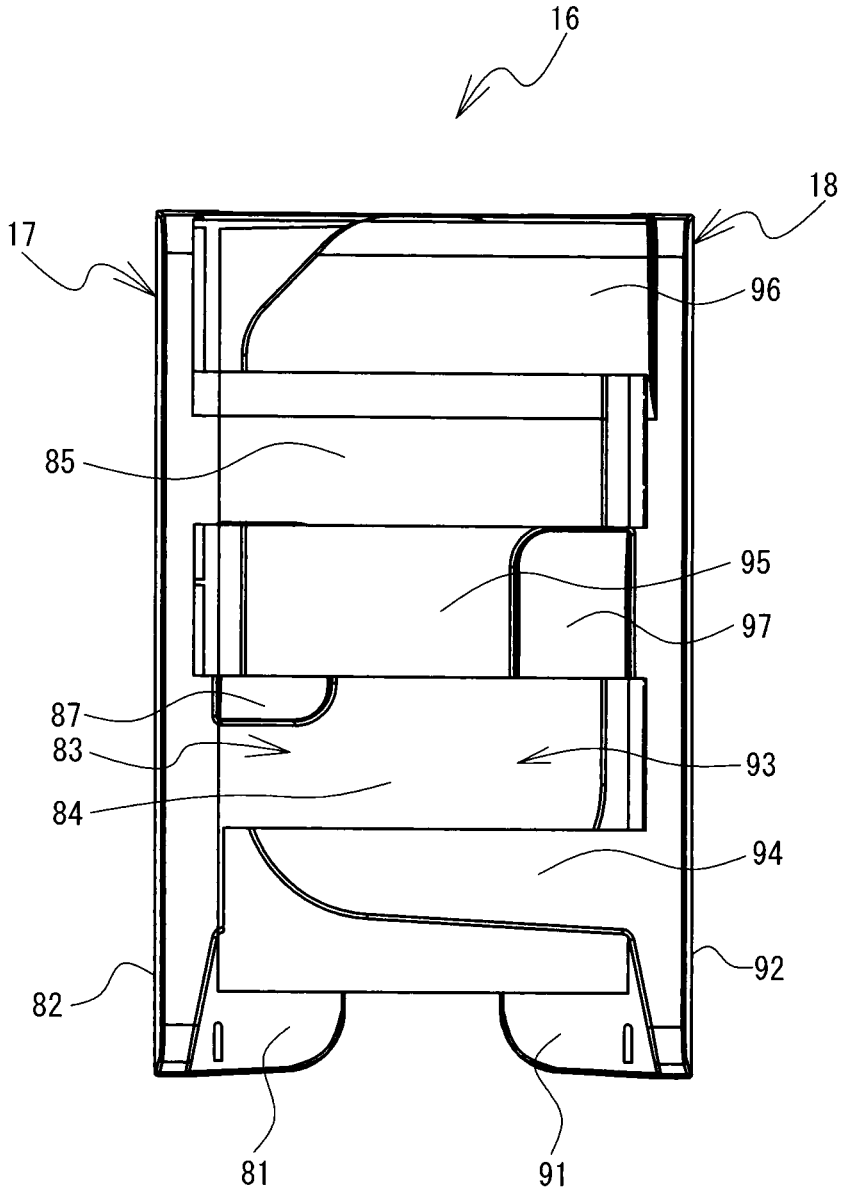
FIG. 11 is a plan view of the sheet guides of the multifunction machine of the another embodiment.
Figure 12:
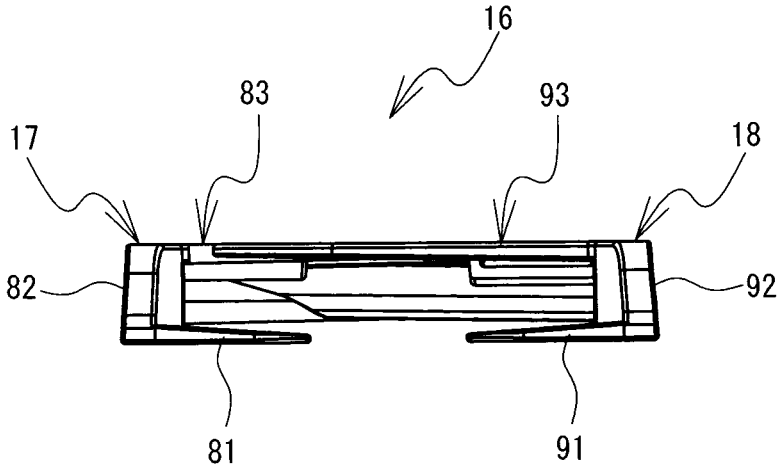
FIG. 12 is a rear view of the sheet guides of the multifunction machine of the another embodiment.

The shape of the sheet guide 16 will be explained with reference to FIG. 9 to FIG. 12. The upper right side, the lower left side, the upper left side and the lower right side of FIG. 9 respectively correspond to the front, the rear, the right side and the left side of the sheet guide 16. The sheet guide 16 includes a first sheet guide 17 and a second sheet guide 18. FIG. 9, FIG. 11 and FIG. 12 each show a state in which the first sheet guide 17 and the second sheet guide 18 are located close to each other. FIG. 10 shows a state in which the first sheet guide 17 and the second sheet guide 18 are separated from each other. As shown in FIG. 9 and FIG. 10, the first sheet guide 17 includes a first placement portion 81, a first regulating portion 82 and a first output tray 83. The second sheet guide 18 includes a second placement portion 91, a second regulating portion 92 and a second output tray 93. The shapes of the first placement portion 81, the first regulating portion 82, the second placement portion 91 and the second regulating portion 92 are the same as those of the first placement portion 61, the first regulating portion 62, the second placement portion 71 and the second regulating portion 72 of the above-described embodiment, and an explanation thereof is therefore omitted here.

The first output tray 83 extends to the left from the first regulating portion 82. As shown in FIG. 10, the length in the width direction of the first output tray 83 is approximately 2.5 times the length in the width direction of the first placement portion 81. The first output tray 83 can support the ejected sheet from the right side in the width direction of the sheet and from below. The second output tray 93 extends to the right from the second regulating portion 92. The length in the width direction of the second output tray 93 is approximately 2.5 times the length in the width direction of the second placement portion 91, and it is the same as the length in the width direction of the first output tray 83. The second output tray 93 can support the ejected sheet from the left side in the width direction of the sheet and from below.

The first output tray 83 includes a first horizontal portion 84 and a second horizontal portion 85. The first horizontal portion 84 and the second horizontal portion 85 extend in parallel with the first placement portion 81, from the upper edge of the first regulating portion 82. The first horizontal portion 84 and the second horizontal portion 85 are plate-shaped portions whose longitudinal direction corresponds to the width direction. The first horizontal portion 84 and the second horizontal portion 85 respectively extend from a second section and a fourth section from the rear in a case where the first regulating portion 82 is equally divided into five sections in the feed direction. Each of the first horizontal portion 84 and the second horizontal portion 85 includes each of the left edges which correspond to end portion of the first output tray 83. At least one of the edges includes a section that comes to closest to the second regulating portion 92 among sections of edge of the first output tray 83.

The second output tray 93 includes a first horizontal portion 94, a second horizontal portion 95 and an inclined portion 96. The first horizontal portion 94 and the second horizontal portion 95 extend in parallel with the second placement portion 91 from the upper edge of the second regulating portion 92. The inclined portion 96 extends from the second regulating portion 92 and is inclined toward the front. The first horizontal portion 94, the second horizontal portion 95 and the inclined portion 96 are plate-shaped portions that extend in the width direction. The first horizontal portion 94, the second horizontal portion 95 and the inclined portion 96 respectively extend from a first section, a third section and a fifth section from the rear in a case where the second regulating portion 92 is equally divided into five sections in the feed direction. Each of the first horizontal portion 94, the second horizontal portion 95 and the inclined portion 96 includes each of the right edges which correspond to end portion of the second output tray 93. At least one of the right edges includes a section that comes to closest to the first regulating portion 82 among sections of edge of the second output tray 93.

As shown in FIG. 10, a recessed portion 87 is provided in the front side of the first horizontal portion 84. A recessed portion 97 is provided in the second horizontal portion 95. The user can easily move the first sheet guide 17 in the width direction by inserting his/her finger in the recessed portion 87. Further, the user can easily move the second sheet guide 18 in the width direction by inserting his/her finger in the recessed portion 97.

In the another embodiment, in a case where the sheet guide 16 is mounted on the feed tray 11, the height from the feed tray 11 to the first output tray 83 is the same as the height from the feed tray 11 to the second output tray 93. An upper surface of the first output tray 83 and an upper surface of the second output tray 93 form a common flat surface, as shown in FIG. 12. Therefore, the ejected sheet is placed, in a horizontal state, on the flat surface formed by the first output tray 83 and the second output tray 93. In this way, the sheet ejected to the first output tray 83 and the second output tray 93 is stably placed on the first output tray 83 and the second output tray 93.

In the another embodiment, also, the first sheet guide 17 and the second sheet guide 18 can be in a proximity state which a distance between the first sheet guide 17 and the second sheet guide 18 is at a minimum. As shown in FIG. 11, in a state in which the first sheet guide 17 and the second sheet guide 18 are located close to each other, the first horizontal portion 94, the first horizontal portion 84, the second horizontal portion 95, the second horizontal portion 85 and the inclined portion 96 are arranged in order from the rear to the front. The left edge of the first output tray 83 is in contact with the second regulating portion 92. The right edge of the second output tray 93 is in contact with the first regulating portion 82. The distance between the first regulating portion 82 and the second regulating portion 92 is smaller than a sum of the lengths, in the width direction, of the first output tray 83 and the second output tray 93. Therefore, the distance between the first regulating portion 82 and the second regulating portion 92 is reduced.

Further, thanks to the inclination of the inclined portion 96, the sheet that is ejected toward the rear can be smoothly guided to the first horizontal portion 84, the second horizontal portion 85, the first horizontal portion 94 and the second horizontal portion 95.

As explained above, in the sheet guide 16 of the another embodiment, the first output tray 83 and the second output tray 93 can be alternately arranged in the feed direction. The left edge of the first output tray 83 can be located closer to the second regulating portion 92 than the right edge of the second output tray 93. The right edge of the second output tray 93 can be located closer to the first regulating portion 82 than the left edge of the first output tray 83. Therefore, the distance between the first regulating portion 82 and the second regulating portion 92 can be shortened. As a result, it is possible to align the sheet having a small width, and thus, the multifunction machine 1 can accurately read the image from the sheet.

In the sheet guide 16, in a state in which the first sheet guide 17 and the second sheet guide 18 are located close to each other, the first horizontal portion 94, the first horizontal portion 84, the second horizontal portion 95, the second horizontal portion 85 and the inclined portion 96 are arranged in order from the rear to the front. The first horizontal portion 84 and the second horizontal portion 85 in the first sheet guide 17 are engaged with the first horizontal portion 94, the second horizontal portion 95 and the inclined portion 96 in the second sheet guide 18. The first horizontal portion 84 and the second horizontal portion 85 are arranged at equal intervals in the feed direction of the sheet. The first horizontal portion 94, the second horizontal portion 95 and the inclined portion 96 are arranged at equal intervals in the feed direction of the sheet. A surface area of the first horizontal portion 84 and the second horizontal portion 85 is substantially the same as a surface area of the first horizontal portion 94 and the second horizontal portion 95. Accordingly, in a state in which the first output tray 83 and the second output tray 93 are separated from each other, the sheet ejected to the first output tray 83 and the second output tray 93 is stably placed thereon.

Further, in order to align and feed the sheet having a small width, it is necessary to move the first sheet guide and the second sheet guide close to each other. Therefore, it is necessary to design the first output tray and the second output tray such that their length in the width direction is short. In this case, the first output tray and the second output tray may not be stably supported from both sides in the width direction. In contrast to this, in the present embodiment, the length in the width direction of the first output tray 83 and the second output tray 93 can be increased. In addition, there is substantially no gap between the first output tray 83 and the second output tray 93. Therefore, the area of the section where the ejected sheet may be placed is further increased. Accordingly, in a state in which the first output tray 83 and the second output tray 93 are separated from each other, the sheet ejected to the first output tray 83 and the second output tray 93 can be stably placed thereon.

Note that, the present disclosure is not limited to the another embodiment and various modifications are possible. Although in the another embodiment, the two horizontal portions 84 and 85 extend from the first regulating portion 82 and the two horizontal portions 94 and 95 extend from the second regulating portion 92, the number of the horizontal portions extending from each of the first regulating portion 82 and the second regulating portion 92 may be one, or three or more. The shapes of the horizontal portions 84, 85, 94 and 95 are not limited to a plate shape that extends in the width direction. One of the horizontal portions may have a substantially triangular shape when it has been seen from above, and the other of the horizontal portions may have a shape that fits the triangular shape. For example, the shape of the other horizontal portion may have a serrated shape.

The first output tray 83 may extend from all sections of the first regulating portion 82 from the rear end to the front end of the first regulating portion 82. The second output tray 93 may extend from all sections of the second regulating portion 92 from the rear end to the front end of the second regulating portion 92. Concavity and convexity may be formed on the left edge of the first output tray 83 and the right edge of the second output tray 93. In a case where the first sheet guide 17 and the second sheet guide 18 are located close to each other, the concavity and the convexity may be engaged with each other.

Figure 13:
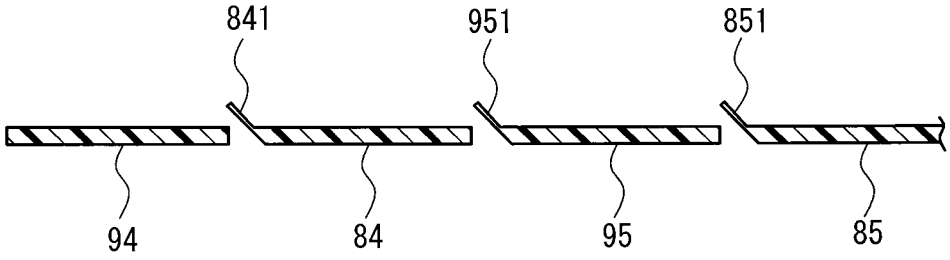
FIG. 13 is a cross-sectional view in the direction of arrows taken along a line I-I when a modified example is applied to FIG. 9.

Further, due to design, there may be a case in which a slight gap of a few millimeters is generated between the first output tray 83 and the second output tray 93. In this case, there is a possibility that the sheet may be caught in the small gap and a sheet ejection performance may deteriorate. In order to prevent the deterioration in the sheet ejection performance, protruding portions 841, 951 and 851 may be provided as shown in FIG. 13, for example. The protruding portions 841, 951 and 851 are provided to respectively cover a gap between the first horizontal portion 94 and the first horizontal portion 84, a gap between the first horizontal portion 84 and the second horizontal portion 95, and a gap between the second horizontal portion 95 and the second horizontal portion 85. The protruding portion 841 extends diagonally upward and rearward from the rear end of the first horizontal portion 84. The protruding portion 951 extends diagonally upward and rearward from the rear end of the second horizontal portion 95. The protruding portion 851 extends diagonally upward and rearward from the rear end of the second horizontal portion 85. The protruding portions 841, 951 and 851 can prevent the sheet ejected toward the rear from being caught in the gap between the first output tray 83 and the second output tray 93. As a result, the sheet that is ejected to the first output tray 83 and the second output tray 93 is smoothly ejected onto the first output tray 83 and the second output tray 93.

Figure 14:
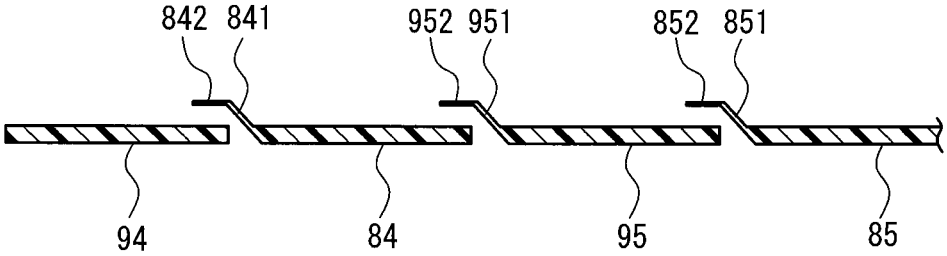
FIG. 14 is a cross-sectional view in the direction of the arrows taken along the line I-I when the modified example is applied to FIG. 9.

Further, upper cover portions 842, 952 and 852 may be provided as shown in FIG. 14. The upper cover portions 842, 952 and 852 extend to the rear from the rear ends of the protruding portions 841, 951 and 851, respectively. The upper cover portions 842, 952 and 852 extend in parallel with the first output tray 83 and the second output tray 93. The upper cover portion 842 extends from the rear end of the protruding portion 841. The upper cover portion 952 extends from the rear end of the protruding portion 951. The upper cover portion 852 extends from the rear end of the protruding portion 851. Since the upper cover portions 842, 952 and 852 are provided, the gap between the first output tray 83 and the second output tray 93 is even more reliably covered. Accordingly, it is possible to even more reliably prevent the sheet from being caught in the gap between the first output tray 83 and the second output tray 93.

The still another embodiment will be explained. The still another embodiment is different from the above-described embodiment in that the sheet guide 13 is replaced by a sheet guide 19. Hereinafter, the sheet guide 19 will be explained. FIG. 1 to FIG. 4 are also applied to the still another embodiment, except that the sheet guide 13 is replaced by the sheet guide 19. The explanation of FIG. 1 to FIG. 4 is omitted.

Figure 15:
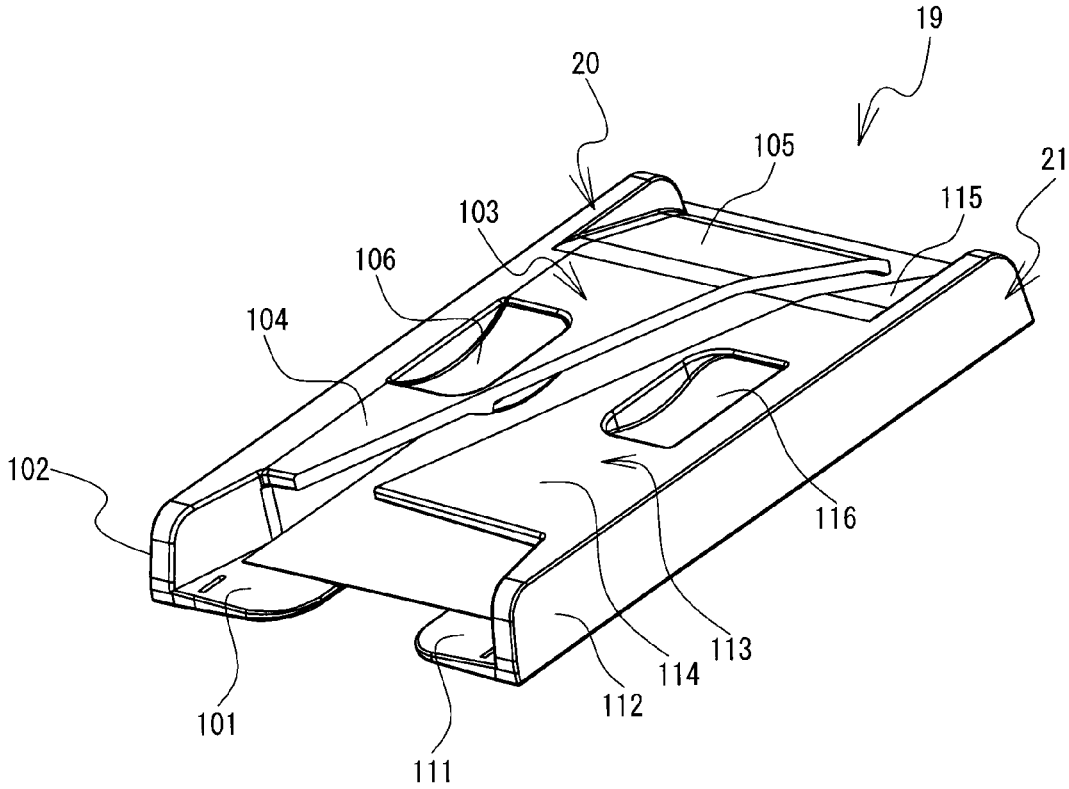
FIG. 15 is a perspective view showing a state in which, among sheet guides of the multifunction machine 1 of a still another embodiment, a first sheet guide and a second sheet guide are located close to each other.
Figure 16:
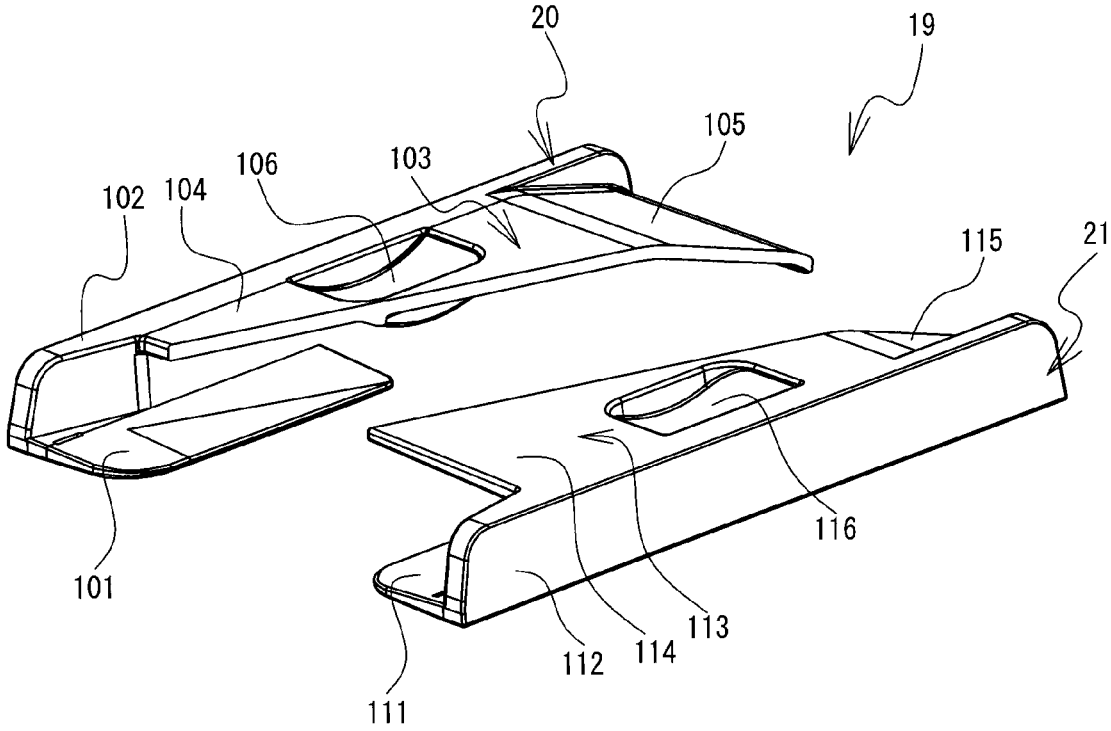
FIG. 16 is a perspective view showing a state in which, among the sheet guides of the multifunction machine of the still another embodiment, the first sheet guide and the second sheet guide are separated from each other.
Figure 17:
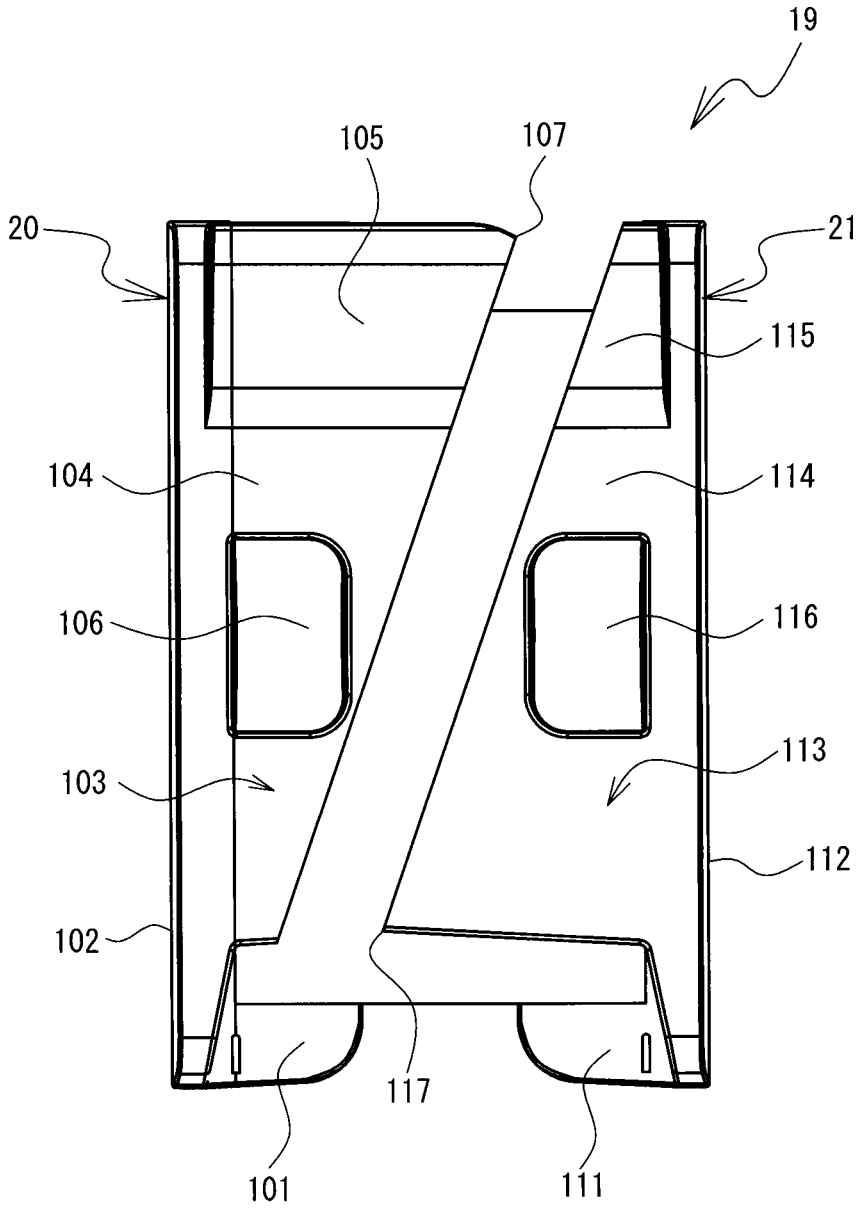
FIG. 17 is a plan view of the sheet guides of the multifunction machine of the still another embodiment.
Figure 18:
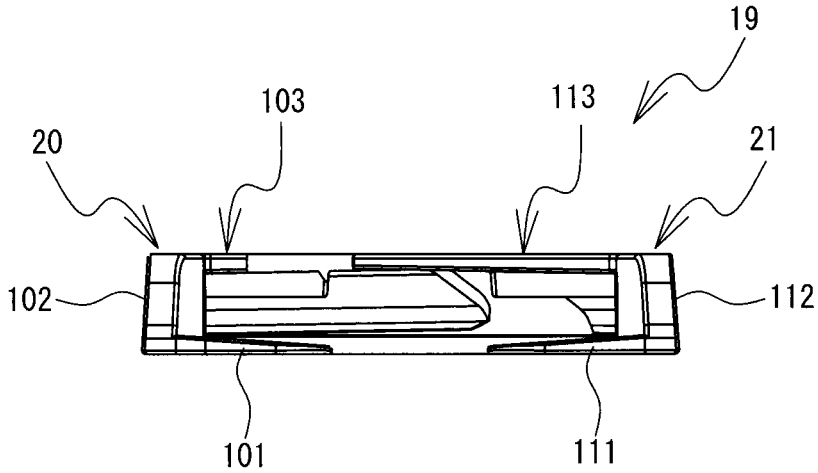
FIG. 18 is a rear view of the sheet guides of the multifunction machine of the still another embodiment.

The shape of the sheet guide 19 will be explained with reference to FIG. 15 to FIG. 18. The upper right side, the lower left side, the upper left side and the lower right side of FIG. 15 respectively correspond to the front, the rear, the right side and the left side of the sheet guide 19. The sheet guide 19 includes a first sheet guide 20 and a second sheet guide 21. FIG. 15, FIG. 17 and FIG. 18 each show a state in which the first sheet guide 20 and the second sheet guide 21 are located close to each other. FIG. 16 shows a state in which the first sheet guide 20 and the second sheet guide 21 are separated from each other. As shown in FIG. 15 and FIG. 16, the first sheet guide 20 includes a first placement portion 101, a first regulating portion 102 and a first output tray 103. The second sheet guide 21 includes a second placement portion 111, a second regulating portion 112 and a second output tray 113. The shapes of the first placement portion 101, the first regulating portion 102, the second placement portion 111 and the second regulating portion 112 are the same as those of the first placement portion 61, the first regulating portion 62, the second placement portion 71 and the second regulating portion 72 of the above-described embodiment, and an explanation thereof is therefore omitted here.

As shown in FIG. 15 and FIG. 16, the first output tray 103 extends to the left from the first regulating portion 102. The first output tray 103 is a substantially triangular shaped plate when it has been seen from above. The length in the width direction of the first output tray 103 is gradually increased from the rear end toward the front. The first output tray 103 includes a horizontal portion 104 and an inclined portion 105. The horizontal portion 104 is a plate-shaped portion that extends in parallel with the first placement portion 101, from the upper edge of the first regulating portion 102. The inclined portion 105 is a portion that is inclined downward from the front end of the horizontal portion 104 toward the front. The length in the width direction of the front end of the inclined portion 105 is approximately 2.5 times the length in the width direction of the first placement portion 101. The first output tray 103 can support the ejected sheet from the right side in the width direction of the sheet and from below.

The second output tray 113 extends to the right from the second regulating portion 112. The second output tray 113 is a substantially triangular shaped plate when seen from above. The length in the width direction of the second output tray 113 is gradually reduced from the rear end toward the front. The second output tray 113 includes a horizontal portion 114 and an inclined portion 115. The horizontal portion 114 is a plate-shaped portion that extends in parallel with the second placement portion 111, from the upper edge of the second regulating portion 112. The inclined portion 115 is a portion that is inclined downward from the front end of the horizontal portion 114 toward the front. The length in the width direction of the rear end of the horizontal portion 114 is approximately 2.5 times the length in the width direction of the second placement portion 111, and it is the same as the length in the width direction of the front end of the inclined portion 105. The second output tray 113 can support the ejected sheet from the left side in the width direction of the sheet and from below.

A recessed portion 106 is provided in a substantially central portion in the front-rear direction of the horizontal portion 104. A recessed portion 116 is provided in a substantially central portion in the front-rear direction of the horizontal portion 114. The user can easily move the first sheet guide 20 in the width direction by inserting his/her finger in the recessed portion 106. Further, the user can easily move the second sheet guide 21 in the width direction by inserting his/her finger in the recessed portion 116.

In the still another embodiment, in a case where the sheet guide 19 is mounted on the feed tray 11, the height from the feed tray 11 to the first output tray 103 is the same as the height from the feed tray 11 to the second output tray 113. An upper surface of the first output tray 103 and an upper surface of the second output tray 113 form a common flat surface, as shown in FIG. 18. Therefore, the ejected sheet can be placed on the formed flat surface in a horizontal state. In this way, the sheet ejected to the first output tray 103 and the second output tray 113 can be stably placed on the first output tray 103 and the second output tray 113. Further, due to the inclination of the inclined portions 105 and 115, the sheet that is ejected toward the rear can be smoothly guided to the horizontal portions 104 and 114.

Further, as shown in FIG. 17, the left edge of the first output tray 103 is parallel to the right edge of the second output tray 113. In the still another embodiment, also, the first sheet guide 20 and the second sheet guide 21 can be in a proximity state which a distance between the first sheet guide 20 and the second sheet guide 21 is at a minimum. In a case where the first sheet guide 20 and the second sheet guide 21 are moved close to each other, the left edge of the first output tray 103 and the right edge of the second output tray 113 come into contact with each other without a gap between them. It is therefore possible to prevent the sheet from slipping down through the gap between the first output tray 103 and the second output tray 113.

Further, the left edge of the first output tray 103 and the right edge of the second output tray 113 are oblique in the width direction with respect to the feed direction. The left edge of the first output tray 103 includes a section 107 which corresponds to end portion of the first output tray 103. The section 107 comes closest to the second regulating portion 112 among sections of the left edge of the first output tray 103. The right edge of the second output tray 113 includes a section 117 which corresponds to end portion of the second output tray 113. The section 117 comes closest to the first regulating portion 102 among sections of the right edge of the second output tray 113. Therefore, the section 107, which is closest to the second regulating portion 112 among sections of the left edge of the first output tray 103, is located closer to the second regulating portion 112 than the section 117, which is closest to the first regulating portion 102 among sections of the right edge of the second output tray 113. Therefore, it is possible to shorten a distance between the first regulating portion 102 and the second regulating portion 112.

As explained above, in the sheet guide 19 of the still another embodiment, the left edge of the first output tray 103 and the right edge of the second output tray 113 are provided in parallel with each other, and the left edge of the first output tray 103 and the right edge of the second output tray 113 are oblique in the width direction, with respect to the feed direction. Thus, it is possible to shorten the distance between the first regulating portion 102 and the second regulating portion 112. As a result, it is possible to align the sheet having a small width, and thus, the multifunction machine 1 can accurately read the image from the sheet.

Note that, the present disclosure is not limited to the still another embodiment and various modifications are possible. The first output tray 103 may extend from one section of the first regulating portion 102 among sections from the front end to the rear end of the first regulating portion 102. The second output tray 113 may extend from one section of the second regulating portion 112 among sections from the front end to the rear end of the second regulating portion 112. The left edge of the first output tray 103 and the right edge of the second output tray 113 may be oblique with respect to the feed direction.

Note that, in the present disclosure, the sheet may be placed on placement portions represented by the first placement portions 61, 81 and 101 and the second placement portions 71, 91 and 111, instead of being placed on the feed tray 11. In other words, the sheet feeding device need not necessarily be provided with the feed tray 11.

In the above-described embodiment, the feed tray 11 extends diagonally upward and rearward. However, the present embodiment is not limited to this example. For example, the feed tray may extend horizontally to the rear. In this case, the sheet guide and the output tray etc. may also extend horizontally to the rear. Further, in a case where the feed tray and the output tray extend diagonally upward and rearward as in the above-described embodiment, a stock portion may be provided that can support a downward end portion diagonally to the front of the sheet ejected to the output tray, as in a known sheet feeding device. By providing the stock portion, it is possible to prevent the ejected sheet from slipping due to the inclination of the output tray.

The multifunction machine 1 of the above-described embodiment is an example of a sheet feeding device, an image reading device and an image forming device of the present disclosure. However, the present disclosure is not limited to this example. For example, the image reading device of the present disclosure may be a sheet-feed scanner that is not provided with an image forming portion. The sheet feeding device of the present disclosure may be a device for feeding sheets, which is not provided with the image reading portion and the image forming portion. Although the multi-function machine 1 is a laser image forming device that uses toner, the present disclosure is not limited to this. The image forming device of the present disclosure may be, for example, a known inkjet image forming device that uses ink.

In the above-described embodiment, a sheet such as a document whose image is read is used as the sheet. However, the sheet is not limited to this example. For example, the sheet may be a recording medium into which characters etc. are recorded by a printer or the like. Further, for example, the sheet may be thick paper, such as card.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sheet feeding device configured to feed a sheet in a feed direction, the sheet feeding device comprising:

a sheet placement portion configured to receive the sheet;

a regulating portion configured to regulate, from both sides in a width direction, a position in the width direction of the sheet placed on the sheet placement portion, the width direction being a direction orthogonal to the feed direction, the regulating portion comprising, a first regulating portion configured to regulate the position in the width direction of the sheet from one of the sides in the width direction;

a second regulating portion configured to regulate the position in the width direction of the sheet from another side in the width direction, and at least one of the first regulating portion and the second regulating portion configured to move in the width direction; and an output portion configured to receive the sheet that is ejected, the output portion comprising, a first output portion that extends from the first regulating portion toward the second regulating portion, the first output portion comprising, a first end portion that comes closest to the second regulating portion among sections of an edge of the first output portion on the second regulating portion side; and a first horizontal portion that extends in parallel with the sheet placement portion, and a second output portion that extends from the second regulating portion toward the first regulating portion, the second output portion comprising, a second end portion that comes closest to the first regulating portion among sections of an edge of the second output portion on the first regulating portion side, and in a proximity state, the first end portion being located closer to the second regulating portion than the second end portion, the proximity state being a state in which a distance between the first regulating portion and the second regulating portion is at a minimum; and a second horizontal portion that extends in parallel with the sheet placement portion.

2. The sheet feeding device according to claim 1, wherein a height from the sheet placement portion to the first output portion is different from a height from the sheet placement portion to the second output portion.

3. The sheet feeding device according to claim 2, wherein in the proximity state, at least a part of the first output portion and at least a part of the second output portion overlap with each other in a vertical direction, the vertical direction being a direction orthogonal to a surface of the sheet.

4. The sheet feeding device according to claim 3, wherein the first output portion further comprises a first cutout portion, the first cutout portion extending from one of an upstream side and a downstream side in the feed direction toward the other of the upstream side and the downstream side in the first output portion; and the second output portion further comprises a second cutout portion, the second cutout portion extending from one of an upstream side and a downstream side in the feed direction toward the other of the upstream side and the downstream side in the second output portion, and at least part of the first cutout portion and at least part of the second cutout portion overlap with each other in the proximity state.

5. The sheet feeding device according to claim 1, wherein a height from the sheet placement portion to the first output portion is the same as a height from the sheet placement portion to the second output portion.

6. The sheet feeding device according to claim 5, wherein in the proximity state, the first output portion and the second output portion are alternately arranged in the feed direction.

7. The sheet feeding device according to claim 5, wherein the edge of the first output portion on the second regulating portion side is oblique with respect to the feed direction of the sheet, and the edge of the second output portion on the first regulating portion side is parallel to the edge of the first output portion on the second regulating portion side.

8. The sheet feeding device according to claim 1, wherein in the proximity state, at least a part of the edge of the first output portion on the second regulating portion side is in contact with the second regulating portion, and at least a part of the edge of the second output portion on the first regulating portion side is in contact with the first regulating portion.

9. An image reading device comprising:

a sheet placement portion configured to receive a sheet to be fed in a feed direction;

a regulating portion configured to regulate, from both sides in a width direction, a position in the width direction of the sheet placed on the sheet placement portion, the width direction being a direction orthogonal to the feed direction, the regulating portion comprising, a first regulating portion configured to regulate the position in the width direction of the sheet from one of the sides in the width direction, and a second regulating portion configured to regulate the position in the width direction of the sheet from another side in the width direction, and at least one of the first regulating portion and the second regulating portion configured to move in the width direction;

a reading portion configured to read an image of the sheet that is fed; and an output portion configured to receive the sheet whose image has been read by the reading portion, the output portion comprising, a first output portion that extends from the first regulating portion toward the second regulating portion, the first output portion comprising, a first end portion that comes closest to the second regulating portion among sections of an edge of the first output portion on the second regulating portion side; and a first horizontal portion that extends in parallel with the sheet placement portion, and a second output portion that extends from the second regulating portion toward the first regulating portion, the second output portion comprising, a second end portion that comes closest to the first regulating portion among sections of an edge of the second output portion on the first regulating portion side, and in a proximity state, the first end portion being located closer to the second regulating portion than the second end portion, the proximity state being a state in which a distance between the first regulating portion and the second regulating portion is at a minimum; and a second horizontal portion that extends in parallel with the sheet placement portion.

10. An image forming device comprising:

a sheet placement portion configured to receive a sheet to be fed in a feed direction is placed;

a regulating portion configured to regulate, from both sides in a width direction, a position in the width direction of the sheet placed on the sheet placement portion, the width direction being a direction orthogonal to the feed direction, the regulating portion comprising, a first regulating portion configured to regulate the position in the width direction of the sheet from one of the sides in the width direction, and a second regulating portion configured to regulate the position in the width direction of the sheet from another side in the width direction, and at least one of the first regulating portion and the second regulating portion configured to move in the width direction;

a reading portion configured to read an image of the sheet that is fed;

an image forming portion configured to perform image forming on a recording medium, based on the image read by the reading portion; and an output portion configured to receive the sheet on which image forming has been performed by the image forming portion, the output portion comprising, a first output portion that extends from the first regulating portion toward the second regulating portion, the first output portion comprising, a first end portion that comes closest to the second regulating portion among sections of an edge of the first output portion on the second regulating portion side; and a first horizontal portion that extends in parallel with the sheet placement portion, and a second output portion that extends from the second regulating portion toward the first regulating portion, the second output portion comprising, a second end portion that comes closest to the first regulating portion among sections of an edge of the second output portion on the first regulating portion side, and in a proximity state, the first end portion being located closer to the second regulating portion than the second end portion, the proximity state being a state in which a distance between the first regulating portion and the second regulating portion is at a minimum; and a second horizontal portion that extends in parallel with the sheet placement portion.

* * * * *